US006058951A

United States Patent [19]

Wilson

[11] Patent Number: 6,058,951

[45] Date of Patent: May 9, 2000

[54] REMOTELY CONTROLLED AND ELECTRICALLY OPERATED UMBRELLAS

[76] Inventor: Robert Joe Wilson, 136 Woodhaven Cir., Athens, Ga. 30606

[21] Appl. No.: 09/123,002

[22] Filed: Jul. 28, 1998

[51] Int. Cl.[7] ..... A45B 25/14

[52] U.S. Cl. ..... 135/20.3; 135/22; 135/98; 116/173

[58] Field of Search ..... 135/20.3, 22, 16, 135/98; 200/49; 116/173; 52/111, 302.5

[56] References Cited

U.S. PATENT DOCUMENTS

| | | | |
|---|---|---|---|
| 2,224,882 | 12/1940 | Peck | 135/20.3 X |
| 2,960,094 | 11/1960 | Small | 200/49 |
| 3,801,809 | 4/1974 | Slade | 135/20.3 X |
| 4,011,881 | 3/1977 | Becher | 135/20.3 |
| 4,079,555 | 3/1978 | Barnes | 52/111 |
| 4,543,971 | 10/1985 | Sirota | 135/22 X |
| 4,562,849 | 1/1986 | Sirota | 135/22 X |
| 4,572,226 | 2/1986 | Williams et al. | 135/22 |
| 5,213,122 | 5/1993 | Grady, II | 135/20.3 |

*Primary Examiner*—Carl D. Friedman
*Assistant Examiner*—Winnie Yip
*Attorney, Agent, or Firm*—John P. Halvonik

[57] ABSTRACT

A remotely or manually actuated electrically operated umbrella for use with larger canopies in outdoor settings like restaurants. The umbrella uses a gear and chain drive system to urge upward a traveling rod that in turn actuates a bracket to open and close the spokes of the umbrella. The rod is controlled by movements of a pulley turned by a motor. Two actuator pieces in connection with the pulley will contact "up" and "down" switches in order to automatically cut off the motor once the canopy has been closed or opened as the case may be.

2 Claims, 4 Drawing Sheets

REMOTELY CONTROLLED AND ELECTRICALLY OPERATED UMBRELLAS

FIELD AND BACKGROUND OF THE INVENTION

The invention relates to the field of remote controlled umbrellas and, in particular, to a mechanism that includes an electric motor drive that operates the opening and closing of the canopies of the umbrellas in response to remote signals sent from a central location.

It is believed that the remotely controlled umbrellas of the present application will have their greatest utility for use with the larger types of umbrellas that find use in outdoor patio settings for restaurants and the like. Such settings usually have a plurality of umbrellas arranged upon the patio Such umbrellas are usually of far larger design than ordinary hand held umbrellas and hence they are heavier and require more force to close them. Typical umbrellas may be of 4–8 feet in diameter and have large wooden spokes as part of the support structure. Such umbrellas may find it helpful to have an electric mechanism for opening and closing these larger type umbrellas rather than relying on manual methods. A remotely operated unit in a central location can then send signals to each of the umbrellas on the patio and hence a large number of umbrellas can be controlled from one central location. Such a remote control mechanism can rapidly close or open any number of umbrellas controlled from the central location and provide for a rapid response to changes in the weather or when it comes time to close the outdoor patio such umbrellas can be rapidly closed down for the night.

DESCRIPTION OF THE PRIOR ART

There are no known remote controlled umbrellas that have the applicant's shut off mechanisms to insure that the umbrella mechanism is not moved too far.

SUMMARY OF THE INVENTION

The invention is used for remote and manually actuation of electrically controlled umbrella for operating opening and closing the canopy of larger type umbrellas. When the electric motor is actuated it then drives a gear and pulley type arrangement in order to drive upward a rod in connection with a bracket to thereby urge open the spokes of the canopy. The spokes and canopy arrangement may be of any state of the art arrangement. The rod is in connection with an actuator on the chain of the pulley so that it will move in response the motor driven movement of the pulley system. This actuator will eventually contact a cutoff switch in order to cutoff further movement of the motor and pulley after the canopy has been opened.

The electric motor operates at least one of the gears of the drive and has the ability to be reversed in direction so as to move the actuators in the opposite direction and hence close the umbrella. When the "close canopy" mode is actuated, the motor is reversed and hence the direction of the pulley is reversed. This will cause the rod to move down and the bracket will move upward by the weight of the canopy on the bracket. The canopy will close. A second actuator on the pulley will then contact a second cutoff switch thereby cutting power to the motor off after the canopy has been closed. There are preferably two actuators in connection with the pulley that can contact the cut off switches in order to automatically cut off the motor once the open position and the closed position has been reached by the canopy.

It is an object of the invention to provide a remote control system for a plurality of umbrellas that can control the opening and closing of a number of such umbrellas from a central location.

Another object of the invention is to provide an electrical drive means for operating a gear and chain drive mechanism to control the opening and closing of an umbrella by a remote signaling means that is in connection with the electric motor.

Other objectives of the invention will become apparent to those skilled in the art once the invention has been shown and described.

DESCRIPTION OF THE PREFERRED EMBODIMENT

Figure 1A:
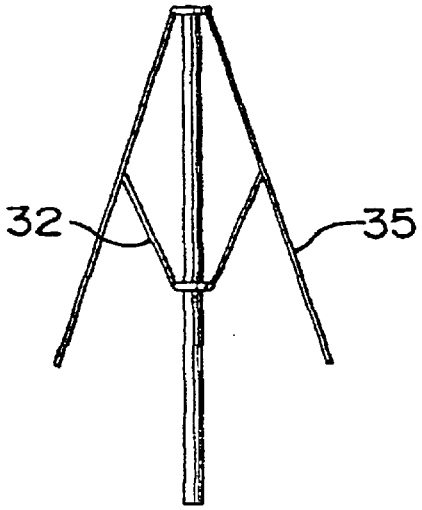
FIG. 1A canopy closed.
Figure 1:
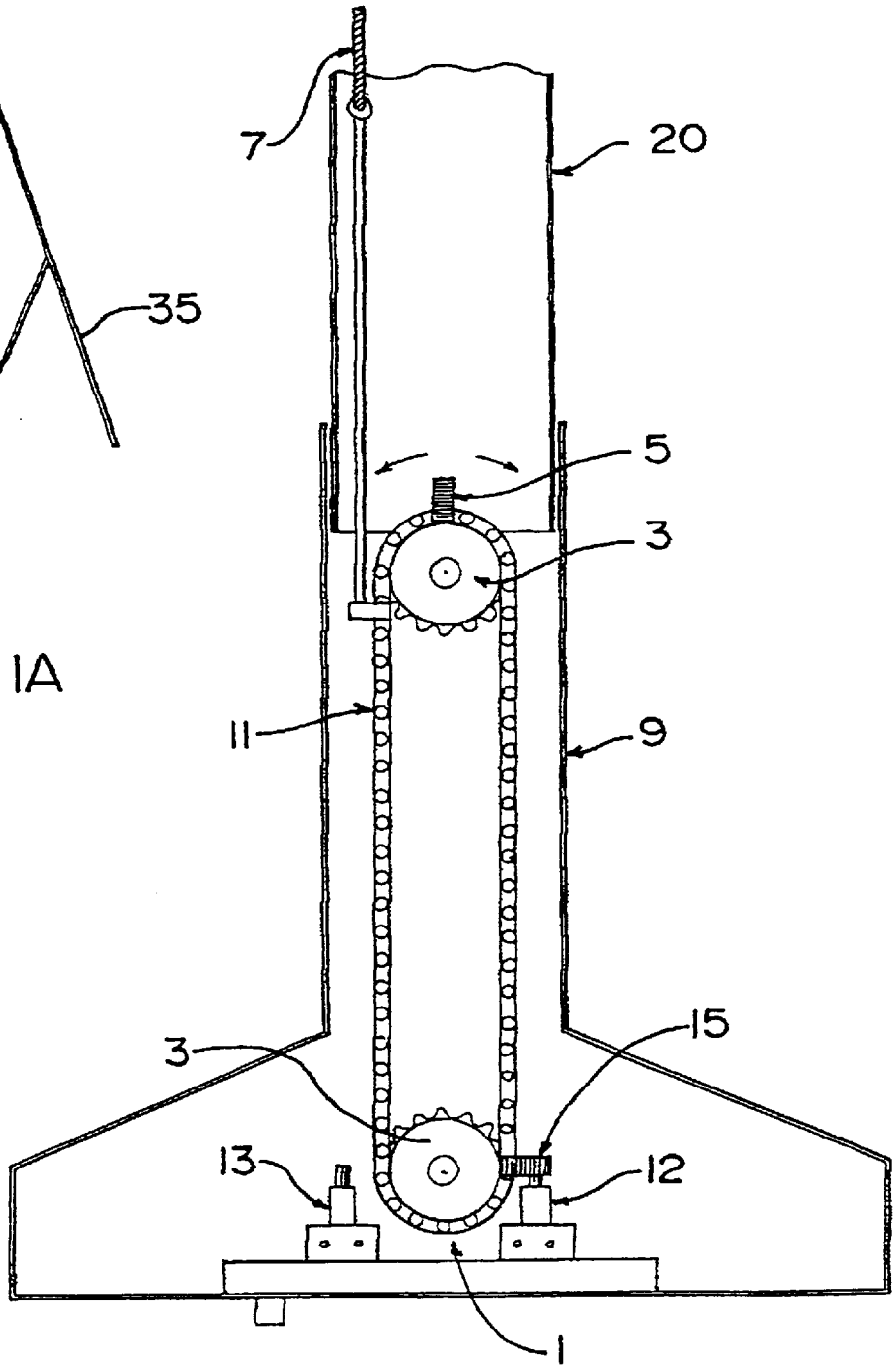
FIG. 1 interior construction showing drive mechanism when fully closed.

The operating means for the canopy of the umbrellas is shown in FIG. 1. The central shaft is shown as 20. A motor 1 is in mechanical connection with at least one of the gears 3. Turning the motor on and off will result in movement of the gears and of course, the pulley 11 in connection with them. The pulley is in connection with the catch actuator 5 that will move in response to the movement of the gears. The gears are preferably powered by an electric motor contained at the base of the shaft. Such base should have an enclosure 9 to house the various parts of the operating mechanism.

The electric motor may be controlled by a remote operating system. The control may be by radio frequency waves or by electric signals sent through a conductive line. These are well known arrangements that come readily to mind, other remote control arrangements are possible without varying from the spirit of the invention. In any event, the control system should be one that can send a signal to drive the motor and hence the gear in one direction and another signal to drive the motor and gear in another direction. In this manner, a central control can be used to send signals to a plurality of remotely located electric motors in the base of each umbrella. Push button operation is also shown with switches 50 and 52 on the outside of the housing in FIG. 4. Both methods of actuating the motor are possible without varying from the spirit of the invention.

Figure 2A:
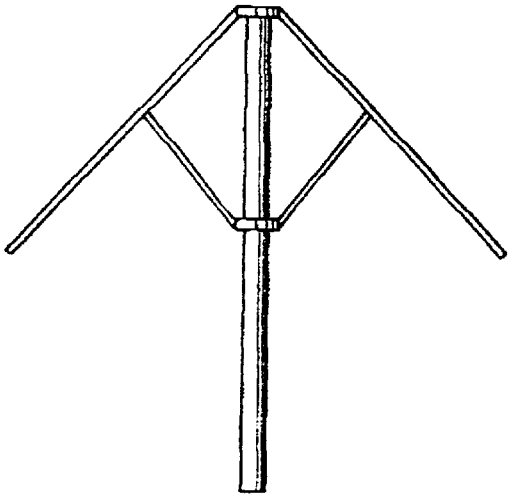
FIG. 2A canopy halfway open.
Figure 2:
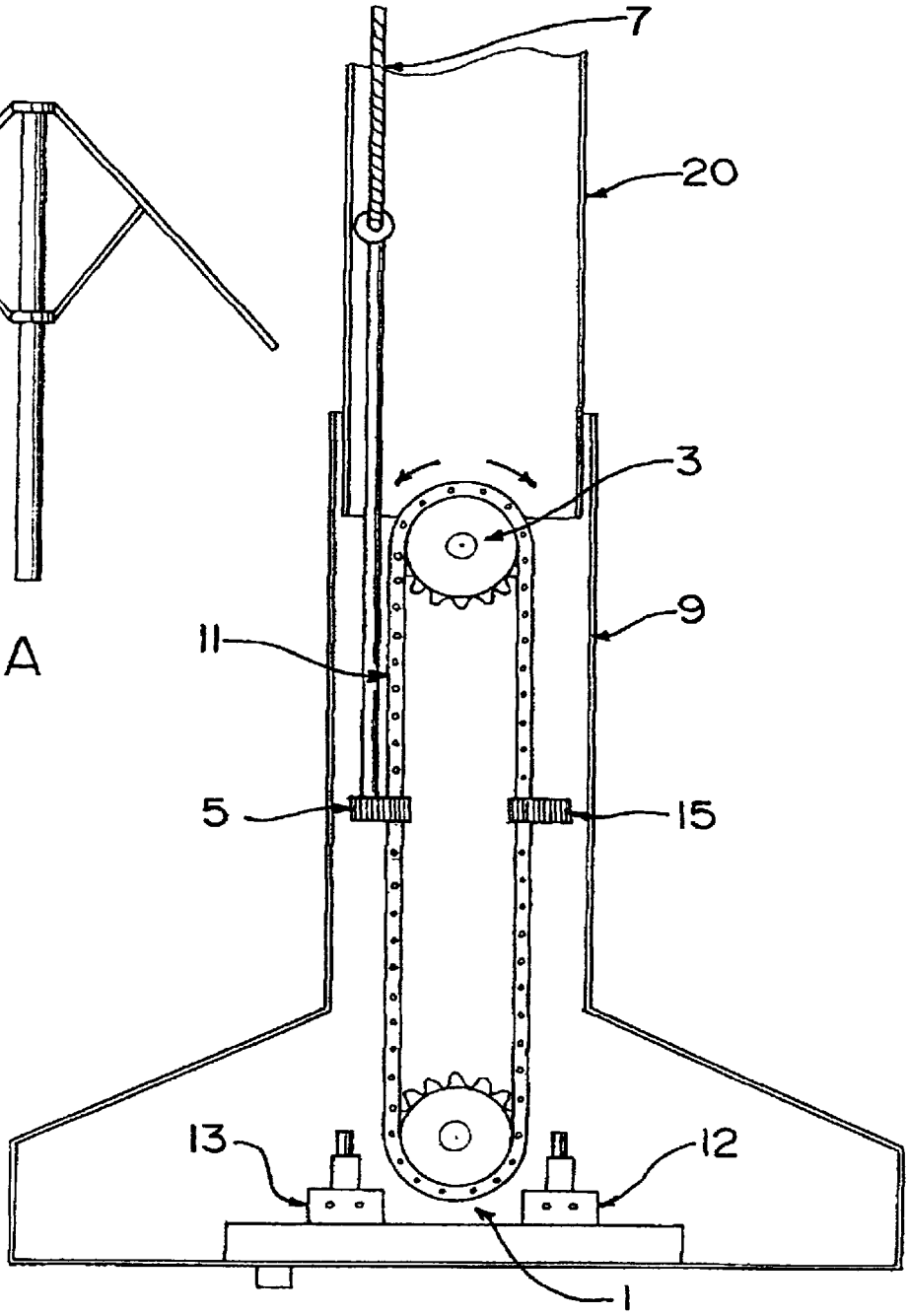
FIG. 2 interior construction showing drive mechanism when umbrella is opening.
Figure 3A:
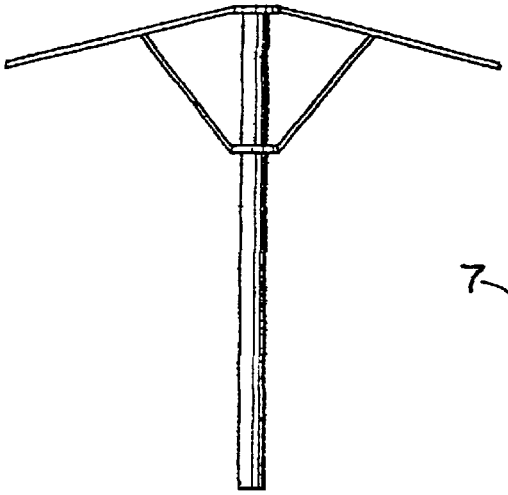
FIG. 3A canopy opened.
Figure 3:
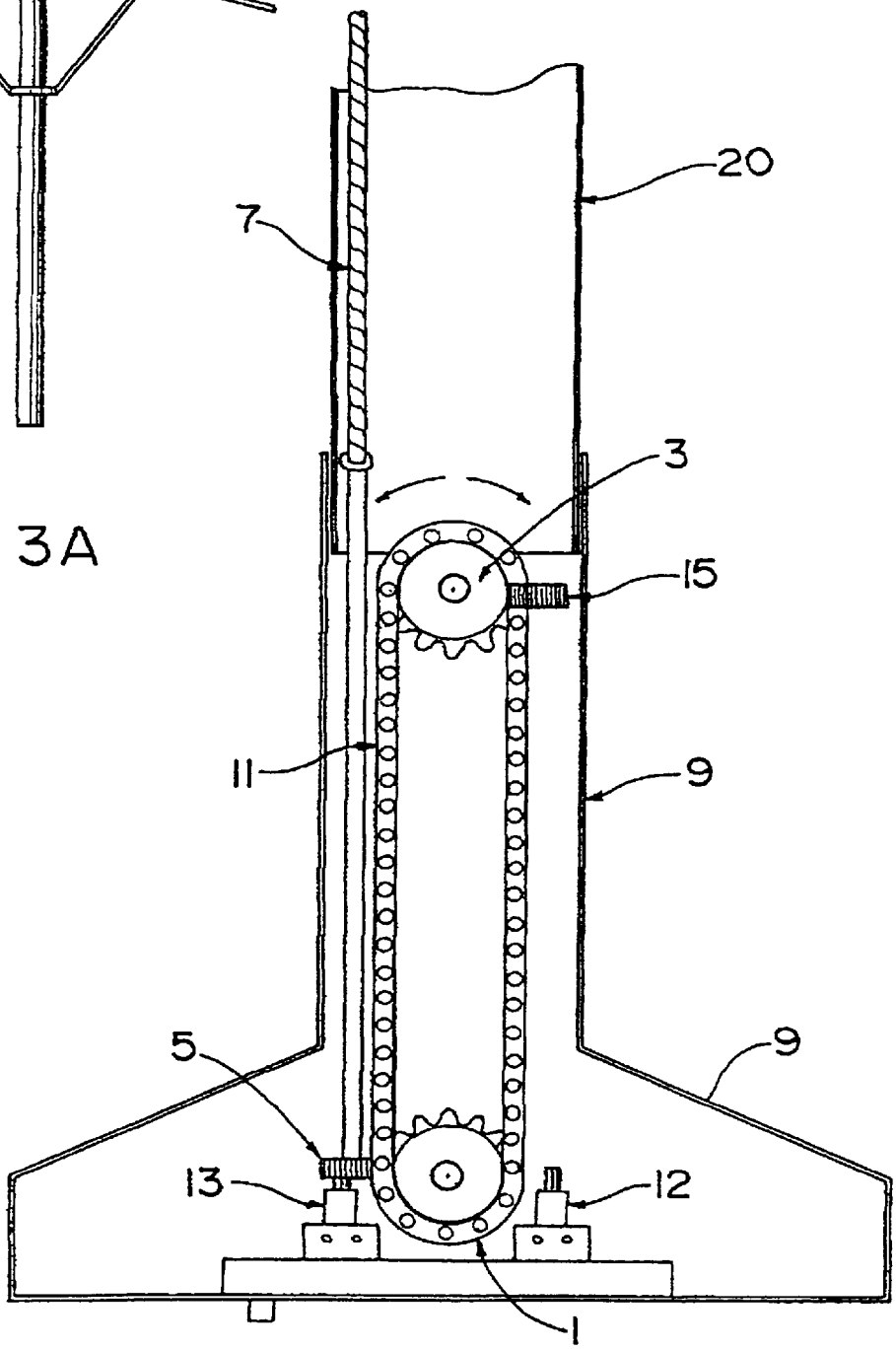
FIG. 3 interior construction showing drive mechanism when fully opened.

The gears are shown as 3 in FIGS. 1–3 and they are in connection with the pulley 11. The pulley can be of metal or plastic or other materials that are known to those skilled in the art. It may be constructed as a chain with links that catch on the teeth of the pulleys. Operation of the motor will turn the pulley and gears in a direction so as to move the chain in one direction. When the control signal for closing the canopy is sent to the motor, the catch actuator 5 should travel in the upward direction assuming normal operation of the spokes 32 and and canopy arms or ribs 35 (Other spoke arrangements may require the nut to travel upward to open the canopy but the description assumes upward travel to open the canopy for purposes of convenience.) Arrows in FIG. 1 refer to "up" for direction of chain travel to open canopy and "down" for direction of travel to close canopy.

The cutoff switches 12 and 13 cut off power to the motor upon coming in contact with one of the actuators 5 or 15. This happens in response to movement of the pulley that begins when the user activates the motor by a separate actuating buttons shown in FIG. 4 or via remote control. In any event, once the movement process is begun the actuators will eventually come into contact with one of the cutoff switches and that will stop movement of the motor and hence stop the pulleys and the other elements from movement.

In FIG. 1, the canopy is in the closed position. (FIG. 1A shows the canopy in this position.). The down switch 12 is "open" at this time and the up switch 13 is "closed." As the chain or pulley 11 turns counter clockwise in FIG. 1, the actuator 5 will grab the bottom portion of rod 7 and will actuate the up switch 13 when it comes in contact with it as it moves downward. This switch will kill the circuit and prevent further upward movement.

Figure 4:
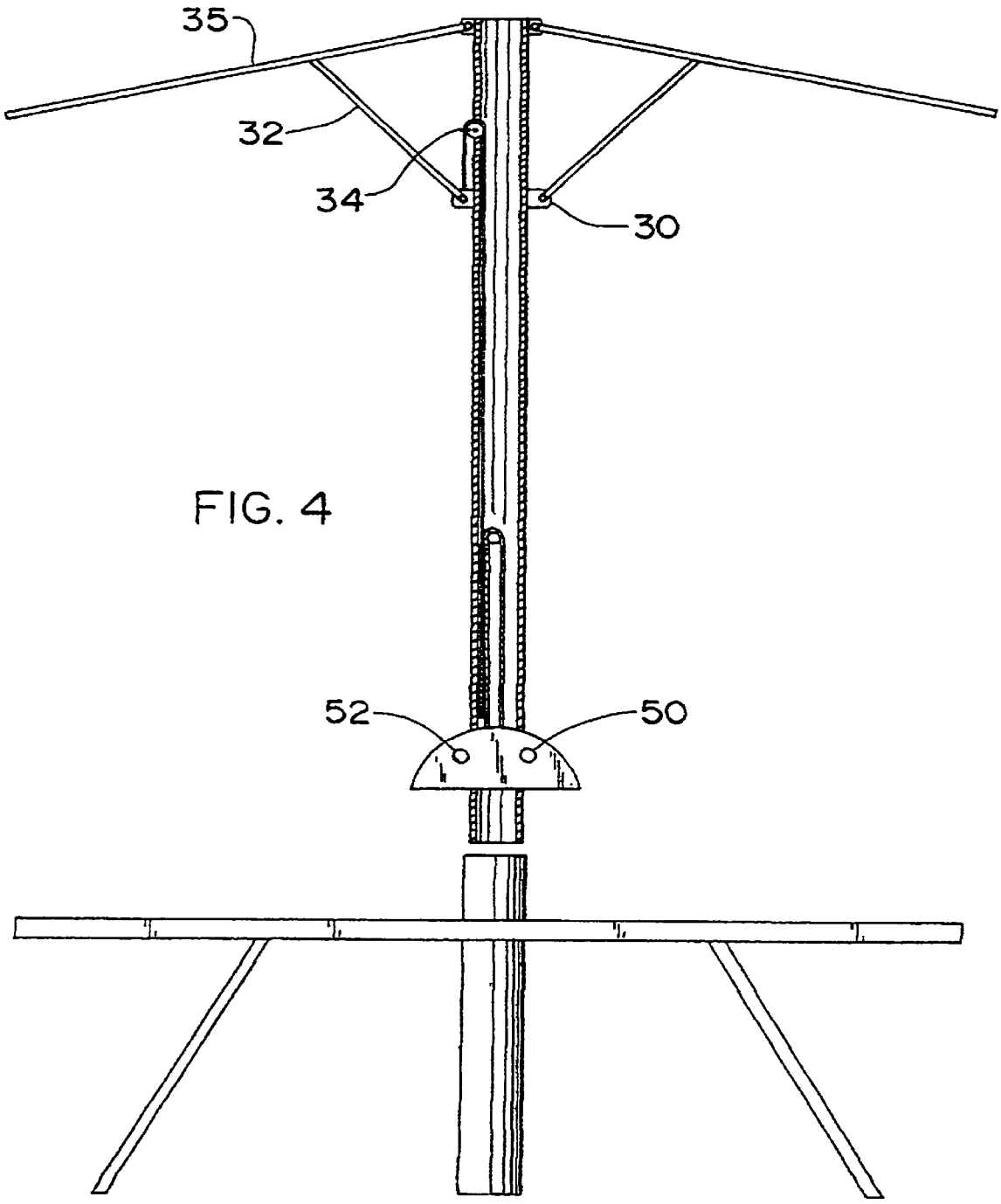
FIG. 4 exterior view showing housing for electronics and actuating buttons for operation.

Note in FIG. 4 that upward movement means the upward movement of the traveling bracket 30 that will move up during this sequence. This bracket moving up will effectively open the umbrella arms 35 shown in FIG. 4. When the kill switch 13 is "open" it will cut off power and the arms of the canopy are prevented from being moved after catch actuator 5 has reached up switch or kill switch 13. Further movement would otherwise cause damage to the arms were the operation of the motor not be cut off. Also note that rod 7 is in connection with bracket 30 and downward movement of rod 7 is translated into upward movement of the bracket to thereby open the umbrella.

When the canopy is being closed, the signal sent to the motor drives it in the opposite direction so that the gears or sprockets 3 turn in the other direction and movement of the pulley is reversed. FIG. 3 shows the position of the components when the umbrella is up. 15 actuator is at the top right of the pulley section. When the down button is pushed (button shown in FIG. 4) this will cause the motor to turn the pulley in the clockwise direction. (see down arrow in FIGS. 1 and 3). This will leave switch 13 open (it does not cutoff any power) and catch actuator 5 will move rod 7 upward and rod 7 will in turn allow the bracket to fall down due to the weight of the canopy on the bracket (the weight of the canopy and bracket should be chosen so that this will occur). This will thereby close the umbrella or canopy. At the same time, the actuator 15 will come down and contact cut off switch 12 ("it will open the switch 12") and thereby shut off further power and prevent the pulley from moving any more.

Other cutoff systems may be used to prevent damage to the spokes and canopy by cutting off power to prevent the components in connection with pulley from moving too far. Such systems may include a cut off mechanism that is operable from the central control unit. The terms clockwise and counter clockwise are used for convenience in describing the drawings, these movements may be reversed in the above description without changing the principle of operation of the invention.

The canopy and supporting ribs or arms 35 are shown in FIG. 2. Spokes 32 in various places are in connection with the bracket 30. Such spoke arrangements for canopies are well known in the art and may be of any variety known to those skilled in the art. The bracket 30 moves up and down the shaft 20 in response to movements from the rod 7. The bracket will move opposite the rod due to the pulley 34 near the top of the shaft. FIG. 1A shows the canopy in closed position.

In many, but perhaps not all spoke arrangements, the upward travel of the bracket in connection with the spokes will result in opening the canopy and the downward travel of the bracket will result in the closing of the canopy. While this is probably the most well known arrangement, other arrangements that involve the use of a bracket that travels up and down the shaft can be used without varying from the spirit of the invention. If the bracket needed to travel downward in order to open the canopy, for example, this could be accommodated within the present invention by simply omitting the upper pulley 30.

While it is believed that the control system disclosed herein will find its greatest utility in controlling large umbrellas such considerations should not be construed as limiting the scope of the applicant's invention. The applicant's invention can find utility with umbrellas of all sizes and those that use different operating mechanisms. It is thought that this invention will find greatest utility in operating larger canopies on the order of 7 feet in diameter or similar sizes.

I claim:

1. An electrically controlled umbrella comprising: a umbrella having a canopy; a plurality of arms in connection with said canopy and a central shaft having an upper and a bottom end, said upper end in connection with said canopy, said bottom end in connection with a housing, a bracket having a plurality of spokes, each of said spokes having one end in connection with said bracket and the other end in connection with one of said arms, said bracket fixed for up and down movement upon said central shaft so that up and down movement of said bracket will open and close said canopy by urging the movement of said arms through the movement of said spokes, a rod in connection with said bracket, a reversing motor in connection with a pulley system for operating said pulley system in a counter clockwise or clockwise direction, said pulley system having pulley and a first and second actuator in connection with a chin, said first and second actuator being spaced apart from one another by a predetermined distance, said motor in connection with a pair of first and second cutoff switches for cutting off power to said motor; said cutoff switches placed on either side of said pulley system in said housing for contact with said first and second actuators during said movement of said pulleys, said cut off switches so placed so that said first actuator will contact said first cutoff switch once said canopy has been opened and said second cut off switch placed so that said second actuator will contact said second cutoff switch once the direction of said motor has been reversed and said canopy has been closed, said first actuator having means for contacting said rod so that movement of said pulley will urge said rod to move said bracket so as to open said canopy.

2. The apparatus of claim 1 further in connection with a remote operating unit, said remote operating unit having a means for operating said motor from a remote location.

* * * * *